US005098365A

United States Patent [19]

Lilja

[11] Patent Number: 5,098,365

[45] Date of Patent: Mar. 24, 1992

[54] METHOD OF CONNECTING A GRIPPING DEVICE TO SHEET OR WEB-FORMED PACKAGING MATERIAL

[75] Inventor: Stig Lilja, Staffanstorp, Sweden

[73] Assignee: AB Profor, Lund, Sweden

[21] Appl. No.: 450,437

[22] Filed: Dec. 14, 1989

[30] Foreign Application Priority Data

Dec. 16, 1988 [SE] Sweden ..... 8804548

[51] Int. Cl.[5] ..... B31B 1/64; B31B 1/90

[52] U.S. Cl. ..... 493/341; 493/87; 493/223; 493/344; 493/380

[58] Field of Search ..... 493/212, 220, 223, 341, 493/344, 345, 377, 380, 383, 930, 936

[56] References Cited

U.S. PATENT DOCUMENTS 3,273,234 9/1966 Henchert ..... 413/14
3,471,351 10/1966 Fuchs .
3,900,155 8/1975 Rausing et al. .
3,977,591 8/1976 Martensson et al. .
4,126,263 11/1978 Martensson .
4,223,789 9/1980 Reil .
4,232,622 11/1980 Weierman ..... 413/14
4,258,876 3/1981 Ljungcrantz .
4,312,450 1/1982 Reil .
4,391,385 7/1983 Rausing .
4,730,769 3/1988 Stark .
4,782,646 11/1988 Nantin ..... 493/212
4,819,839 4/1989 Carlsson et al. .

*Primary Examiner*—Frederick R. Schmidt
*Assistant Examiner*—Jack Lavinder
*Attorney, Agent, or Firm*—Burns, Doane, Swecker & Mathis

[57] ABSTRACT

A method is disclosed of attaching a gripping device to a sheet of packaging material that is to be formed into a container includes the steps of forming a hole in the sheet of packaging material, inserting an anchorage device in the hole, sealing the anchorage device to the sheet of packaging material in a liquid-tight manner and fixedly connecting a gripping device to the anchorage device.

7 Claims, 1 Drawing Sheet

METHOD OF CONNECTING A GRIPPING DEVICE TO SHEET OR WEB-FORMED PACKAGING MATERIAL

FIELD OF THE INVENTION

The present invention relates to a method of attaching a gripping device to a sheet of material. More particularly, the present invention concerns a method of attaching a gripping device to a sheet of packaging material that is to be formed into a container.

BACKGROUND OF THE INVENTION

Single-use disposable packages are often manufactured from flexible packaging material which, by suitable processing, folding and sealing, is formed into packages of the desired configuration. The packages are often provided with some form of opening arrangement, for example a region of the material weakened by perforation, this region being, on the outside of the package, connected to a gripping device in the form of a plastic pull-ring or the like, with the aid of which the package may thus be opened.

Packages of the above-mentioned type are also employed for the packaging of previously sterilized contents, for example UHT treated long-life milk. In such cases, the packaging material must be sterilized prior to being brought into contact with the contents. To sterilize the packaging material the packaging material, while it is still in the web or sheet form to is brought into contact with a liquiform chemical sterilization agent which, after having been in contact with the packaging material for the requisite time to obtain the desired level of bacterial extermination, is once again removed from the material. Application of the sterilization agent to the packaging material may be effected, for instance, by passing the packaging material web through a bath of sterilization agent, or by vaporizing the sterilization agent directly onto the web. Since the surplus sterilization agent is, after the requisite contact time, removed from the material web by means of, for example, squeezer rollers or hot air knives, it is of the utmost importance that the material web does not display creases or other irregularities, for example folded regions or pre-applied details, since these would, on the one hand entrain an undesirably large volume of sterilization agent, and, would also render impossible the thorough removal of the sterilization agent after the treatment time. For this reason, it has not hitherto been possible to fit such pre-applied details as gripping devices or the like to packaging material which is, by forming and/or sterilization processes, to be converted into individual packages of the above-mentioned type.

Hence, it is generally desirable within this art to develope a method of applying a gripping device to an aseptic package which is sterilized by the application of a liquiform sterilization agent to the packaging material prior to being formed into a finished package.

OBJECTS OF THE INVENTION

One object of the present invention is to provide a method of connecting a gripping device to sheet or web-formed packaging material, this method making possible, without any inconvenience, the sterilization of the packaging material by means of a liquiform sterilization agent in packaging machines of the conventional type.

A further object of the present invention is to provide a method of connecting a gripping device to sheet or web-formed packaging material, the method permitting reliable and liquid-tight anchorage of the gripping device in the packaging material.

SOLUTION

These and other objects have been attained according to the present invention in that a method of connecting a gripping device to sheet or web-formed packaging material includes providing the packaging material with an opening in which an anchorage device is inserted and sealed to the packaging material, in a liquid-tight manner the anchorage device being, after processing of the packaging material, connected to the gripping device.

By first providing the packaging material with an anchorage device which may pass unimpeded through prior art sterilization and forming apparatuses and thereafter connecting the anchorage device to the gripping device proper, the above-outlined drawbacks in sterilization and handling of the web or sheet-formed material will be obviated at the same time, as the fixing of the connection between the anchorage device and the gripping device will be extremely reliable and, as a result, well-suited for the tearing-up of opening arrangements in packaging material types which are relatively difficult to tear.

BRIEF DESCRIPTION OF THE DRAWINGS

One preferred embodiment of the method according to the present invention will now be described in greater detail with particular reference to the accompanying drawings in which.

DESCRIPTION OF PREFERRED EMBODIMENT

Figure 1:
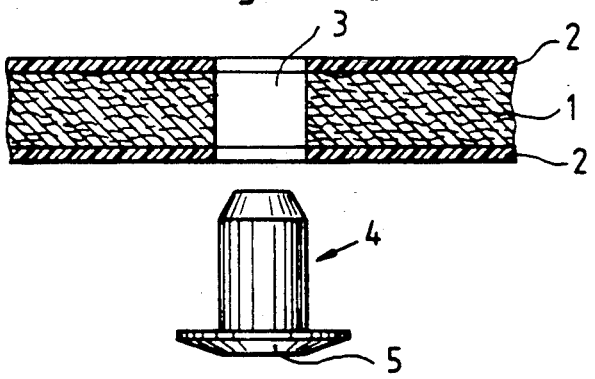
FIG. 1 is a cross-sectional view of a portion of a packaging material prior to the application of an anchorage device.

Referring to the drawings, a packaging material which is often employed in the manufacture of liquid-tight packages of the single-use disposable type, for example packages or cartons for milk, juice or the like, is shown in FIG. 1 and essentially comprises a central layer 1 of carrier material, for example paper or foamed plastic which, on either face, is coated with liquid-tight layers 2 of thermoplastic material, for example polyethylene. For carrying out the method according to the present invention, the packaging material is provided, at suitable places, with a through hole 3 whose diameter may vary but should preferably be between 3 and 10 mm.

An anchorage device 4 for application in the hole 3 is of a diameter which substantially corresponds to the diameter of the hole 3, and has a relatively flat head 5 of larger diameter. The anchorage device 4 is preferably manufactured of a thermoplastic material of the same type as the thermoplastic material included in both of the outer layers 2 of the packaging material, i.e. polyethylene.

After application of the anchorage device 4 in the hole 3, both the anchorage device and the surrounding regions of the two exterior thermoplastic layers of the packaging material are heated to the melting temperature, whereafter press tools (not shown) compress the anchorage device 4 from both directions, so that the thermoplastic material flows out and forms a head also on the opposing side of the packaging material 1. The anchorage device 4 will be "riveted" in place and hot-sealed to both of the thermoplastic outer layers 2 of the packaging material 1, such that completely liquid-tight seals will be obtained which prevent sterilization agent or package contents from penetrating in under the two heads of the anchorage device 4 and permeating into the central carrier layer 1 of the packaging material. By selecting a suitable configuration of the working surfaces of those tools which are employed for forming both of the heads 5 of the anchorage device 4, it will be ensured that the heads 5 have a flat, elongate form which closely coincides with the external surfaces of the packaging material. By utilising relatively high compressive pressure in the forming operation, the central carrier layer 1 of the packaging material may moreover be compressed somewhat, so that the heads 5 of the anchorage device 4 do not, in actual fact, need entail any thickening of the material but may lie wholly flush with the surface layer 2 of the packaging material. It will hereby be ensured that the packaging material provided with anchorage devices 4 may pass unimpeded through both various apparatuses for processing and sterilizing and through rollers and guides which are necessary in reforming the material into individual packages or cartons.

Figure 2:
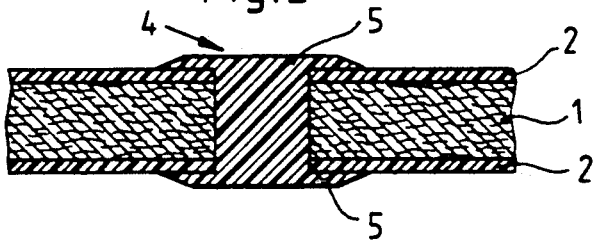
FIG. 2 is a cross-sectional view of the portion of the packaging material of FIG. 1 after the application of the anchorage device.

When the packaging material has been provided with anchorage devices 4 formed substantially in accordance with that shown in FIG. 2, the material is subjected to the desired processing, for example forming into packages or sterilization treatment. When the packaging material in web or sheet form is brought into contact with a liquiform sterilization agent, for example hydrogen peroxide, will the sterilization agent adhere to all external surfaces of not only both of the outer plastic layers 2 of the packaging material, but also the heads 5 of the anchorage device 4. However, the sterilization agent cannot penetrate in under the heads of the anchorage device. This also thereby ensures that the sterilization agent can, after the desired treatment time, be completely removed from the material web using, for example, squeezer rollers and so-called air knives, i.e. concentrated hot air curtains. After sterilization of the packaging material, the packaging material is formed into packages which, in the wholly or partly finished state, are filled with their intended contents and then sealed. Such operations are effected in a conventional manner and, consequently, reference is here made to European Patent Specification EP 91 712 for further information.

Figure 3:
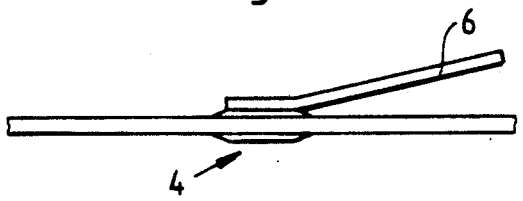
FIG. 3 shows, on a smaller scale, a portion of the packaging material which has been provided with a gripping device in accordance with the method according to the present invention.
Figure 4:
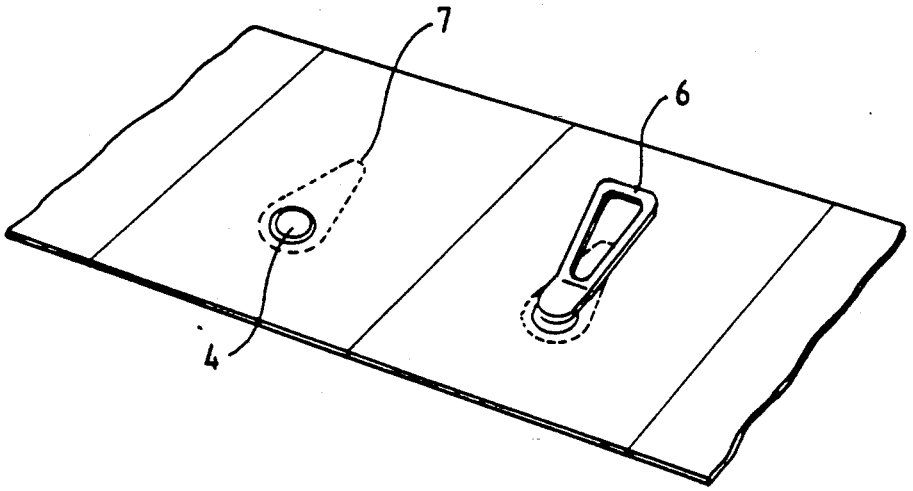
FIG. 4 shows, partly in perspective, a portion of a packaging material web provided with an opening arrangement with a gripping device produced in accordance with the method according to the present invention.

After sterilization of the packaging material and/or the forming processing thereof, gripping devices 6 (FIG. 3) are applied to the packaging material at those places where the packaging material has been provided with anchorage devices 4. The gripping devices 6, which may be designed as a pull-ring or the like, are manufactured of a thermoplastic material which may readily be sealed to the anchorage device 4 and preferably consists of the same material type, for example polyethylene.

By employing the above-disclosed process, there will be obtained a reliable securement not only of the gripping device 6 to the one head 5 of the anchorage device 4, but also of the anchorage device to the packaging material, which is of considerable importance, for instance, when the gripping device 6 is to be utilised as a pull-ring in an opening arrangement of the type in which a part of the packaging material is torn-off when the package or carton itself is opened. Such opening arrangements are well-known in this Art and essentially comprise an openable region of the wall of the package, the region having been defined by, for example a tearing line, in the form of a perforation 7 which extends partially through the packaging material 1 and runs in a closed arc around that region which is to be opened. By designing the head 5 of the anchorage device 4 in such a manner that its edge is partly contiguous with the above-mentioned line of weakening, initiation of the tearing operation will be facilitated, which further reduces the risk that the opening function fails to work satisfactorily.

The method according to the present invention, on which the gripping device is applied in two stages, also packages having an external gripping device, to be sterilized through use of chemical agents which has not hitherto been possible. The application of the anchorage device 4 prior to sterilization of the packaging material results in no hindrance and entails no disadvantages, be it in the sterilization of the material or in the other handling and processing operations involved in forming the package, also, the attached anchorage device 4 constitutes an excellent anchorage point for the subsequent application of the gripping device 6, which may readily be effected by heating and compressing the one end of the gripping device and the head of the anchorage device disposed on the outside of the package.

While this invention has been illustrated and described in accordance with a preferred embodiment, it is recognized that variations and changes may be made and equivalents employed herein without departing from the invention as set forth in the claims.

What is claimed is:

1. A method of attaching a gripping device to a sheet of packaging material that is to be formed into a container comprising the steps of:

forming a hole in a sheet of packaging material;

inserting an anchorage device in said hole;

sealing the anchorage device to opposite sides of the sheet of packaging material in a liquid-tight manner; and mounting a gripping device on the anchorage device after insertion of the anchorage device in the hole.

2. The method in accordance with claim 1, wherein said anchorage device is fabricated from thermoplastic material, said anchorage device including a cylindrical central portion having an enlarged head at one end thereof and an oppositely positioned free end, said anchorage device being inserted in the hole by inserting the free end of the cylindrical central portion into the hole from one side of the sheet of packaging material such that the free end extends out beyond the opposite side of the sheet of packaging material.

3. The method according to claim 2, wherein said step of sealing the anchorage device to the packaging material includes heating the anchorage device and the packaging material to a melting temperature and compressing the free end of the cylindrical portion and the enlarged head towards one another to form an enlarged head portion at the free end of the cylindrical central portion and to heat-seal the anchorage device to the sheet of packaging material.

4. The method according to claim 1, including the step of sterilizing the sheet of packaging material after the anchorage device is sealed to the sheet of packaging material by bringing the sheet of packaging material into contact with a chemical sterilization agent.

5. The method according to claim 4, wherein the gripping device is fixedly connected to the anchorage device after the packaging material is sterilized.

6. A method of processing a sheet of packaging material that is to be used in the formation of containers, comprising the steps of:

forming a hole in the sheet of packaging material;

inserting an anchoring device into the hole;

heating the anchoring device and the packaging material;

pressing opposite ends of the anchoring device towards each other to heat seal the anchorage device to the packaging material in a liquid-tight manner;

sterilizing the sheet of packaging material by bringing the sheet of packaging material into contact with a chemical sterilization agent;

removing the chemical sterilization agent from the sheet of packaging material; and securing a gripping device to the anchorage device after removing the chemical sterilization agent.

7. The method of claim 6, wherein said securing step is performed by heat sealing the gripping device to the anchoring device.

* * * * *